US006577990B1

(12) United States Patent
Kotlow et al.

(10) Patent No.: US 6,577,990 B1
(45) Date of Patent: Jun. 10, 2003

(54) METHOD FOR DETERMINING LAUNCH SYSTEM VELOCITY, ACCELERATION AND DISPLACEMENT CERTIFICATION PARAMETERS

(75) Inventors: Dominik A. Kotlow, Wakefield, RI (US); Peter R. Witting, Middletown, RI (US); James W. Coleman, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 418 days.

(21) Appl. No.: 09/606,114

(22) Filed: Jun. 12, 2000

(51) Int. Cl.[7] ..... H04B 15/00

(52) U.S. Cl. ..... 702/190; 702/17; 702/57; 702/64; 702/190; 73/1.37; 73/489; 73/514.01; 114/20.1; 114/22; 114/312; 114/318; 324/76.28; 324/76.44; 324/76.68

(58) Field of Search ..... 702/17, 33, 57, 702/64, 65, 66, 71, 75, 98, 104, 105, 106, 138, 142, 145, 176, 190, 193; 708/300, 303, 304, 305, 313; 73/1.37, 1.01, 1.38, 1.39, 1.79, 488, 489, 490, 491, 492, 493, 494, 495, 514.01; 114/20.1, 20.2, 22, 25, 312, 316, 318; 324/76.28, 76.29, 76.44, 76.68, 76.45

(56) References Cited

U.S. PATENT DOCUMENTS 3,807,274 A * 4/1974 Cohen ..... 89/1.81
6,112,161 A * 8/2000 Dryden et al. ..... 702/85

* cited by examiner

*Primary Examiner*—Marc S. Hoff
*Assistant Examiner*—Elias Desta
(74) *Attorney, Agent, or Firm*—James M. Kasischke; Michael F. Oglo; Jean-Paul A. Nasser

(57) ABSTRACT

A method is provided to process system test data to determine certification parameters of the system based on the test data. For a torpedo launch system, the velocity data is generated by a Pressure/Velocity/Displacement housing interfaced with a computer based data acquisition system and known launch system and test parameters, such as sample rate, muzzle exit length, time of acquisition, decimation factor and low pass cutoff frequency are provided as inputs. The method forces assigns a value of zero to any data less than a predetermined threshold in order to eliminate non-zero levels contributed by ambient noise. The method then passes the data through a filter chosen to agree with hand fit smoothing methods, so as to obtain a smoothed velocity profile. The smoothed data is processed to obtain and display an acceleration profile and a displacement profile, as well as data points for peak acceleration, time at peak, acceleration pulse width, muzzle exit velocity and time at exit.

14 Claims, 4 Drawing Sheets

METHOD FOR DETERMINING LAUNCH SYSTEM VELOCITY, ACCELERATION AND DISPLACEMENT CERTIFICATION PARAMETERS

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to launch system testing, and more particularly to a method for determining velocity, acceleration and displacement parameters of a projectile being launched from a muzzle or tube of the launch system.

(2) Description of the Prior Art

In order to certify the proper operation of a launch system, such as that used to launch a torpedo from a submarine tube, it is necessary to obtain velocity/time data from the projectile launched by the system. Based on this data, launch velocity, acceleration and displacement parameters can be derived. Current certification procedures for torpedo launch systems rely on a Pressure/Velocity/Displacement (PVD) housing mounted on a breech door of the tube. A wire is attached to the projectile being launched. In the case of a torpedo launch system certification, a shape is launched, which represents the torpedo. When the projectile is launched, the wire is pulled behind the projectile from a reel, which spins a DC generator within the PVD housing. The resulting voltage signal can be read by a computer based data acquisition system and converted to a velocity/time distribution plot. However, the PVD housing provides inherently noisy velocity signals attributed to the gear meshing of the DC generator and the wire payout being subjected to the launch pulse. The noisy data must be filtered in such a way as to obtain representative acceleration and displacement characteristics, which can be compared to launch system specifications to certify the launch system. Additionally, cabling results in a DC shift of the data. However, simply adjusting the PVD data to account for the DC shift and applying standard filtering methods may compromise the calibration of the PVD and cause a phase shift between the displacement and velocity profiles. This may lead to erroneous velocity, displacement, and acceleration time histories and inappropriate interpretation of muzzle and hull exit values.

SUMMARY OF THE INVENTION

Accordingly, it is an object of the present invention to provide a method to obtain velocity signals for a launch system, which minimizes the noise components of the signal.

Another object of the present invention is to provide a method to obtain velocity signals for a launch system, which maintains zero phase shifting of the data.

A further object of the present invention is to provide a method to obtain velocity signals for a launch system, which can provide a smooth fit for the velocity/time distribution in order to obtain accurate acceleration and displacement characteristics of the launch system.

Still another object of the present invention is to provide a method to obtain velocity signals for a launch system, which retains the frequency response appropriate for torpedo launched shapes.

Other objects and advantages of the present invention will become more obvious hereinafter in the specification and drawings.

In accordance with the present invention, a method is provided to process velocity data obtained by a PVD housing. The velocity array data is captured by a computer based data acquisition system. Other launch system and test parameters, such as sample rate, muzzle exit length, time of acquisition, decimation factor and low pass cut-off frequency, are provided as inputs for the operation of the method. The method first takes any data less than a predetermined value and assigns to it a value of zero. This serves to eliminate stray, DC cable induced voltages. The method then passes the data and input parameters through a forward/reverse $5^{th}$ order 6 Hz low pass elliptic filter, resulting in smoothed velocity data. The filter allows 0.005 dB bandpass ripple and a stopband attenuation of 130 dB. This smoothed data is processed to obtain and display an acceleration profile and a displacement profile, as well as to obtain peak acceleration, time at peak, pulse width, muzzle exit velocity and time at exit.

By assigning a value of zero to data below a specified threshold, the method eliminates cable induced voltage components of the signal. The $5^{th}$ order 6 Hz low pass elliptic filter maintains zero phase shifting of the data and provides a smoothed velocity profile of the data, from which accurate and repeatable acceleration and displacement profiles can be determined. The filter used in the method is chosen to retain the frequency response appropriate for torpedo launched shapes.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
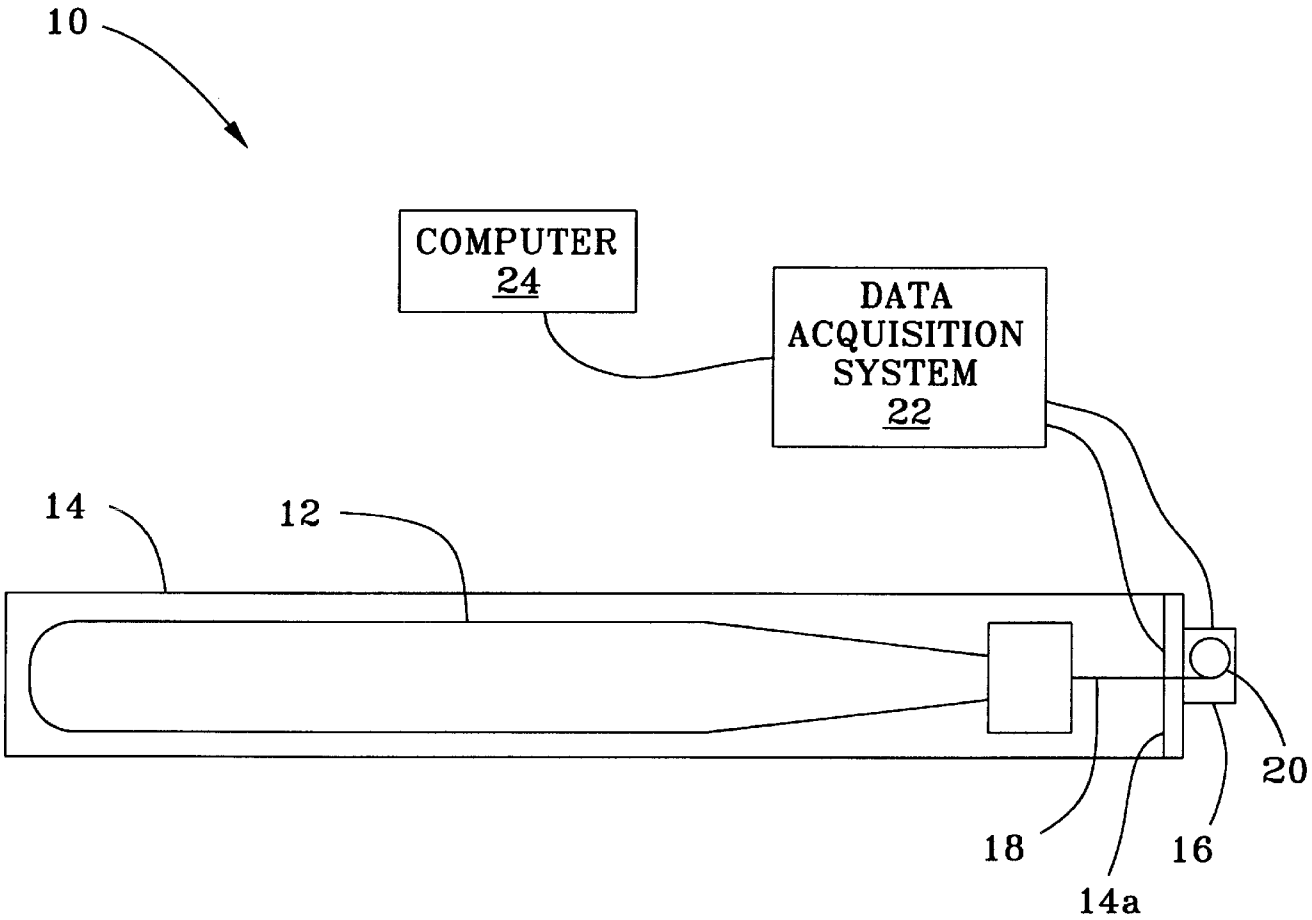
FIG. 1 PRIOR ART
FIG. 1 is a schematic representation of a prior art launch system for use with the present invention.

Referring now to FIG. 1, there is shown a prior art torpedo launch system 10. In order for launch system 10 to be certified as acceptable, launch system parameters must be determined to be within specified ranges. These parameters include muzzle exit velocity, peak acceleration and acceleration duration above certain thresholds for torpedo 12 as it is launched from the tube 14. A PVD housing 16 is mounted on the dry side of tube 14 and is attached to torpedo 12 via wire 18 passing through breech door 14*a*. As torpedo 12 is launched, wire 18 is pulled from PVD housing 16, spinning DC generator 20 within housing 16. The resulting voltage varies with the speed of torpedo 12 as it is launched from tube 14. Computer controlled data acquisition system 22 receives the voltage signals for processing.

Figure 2:
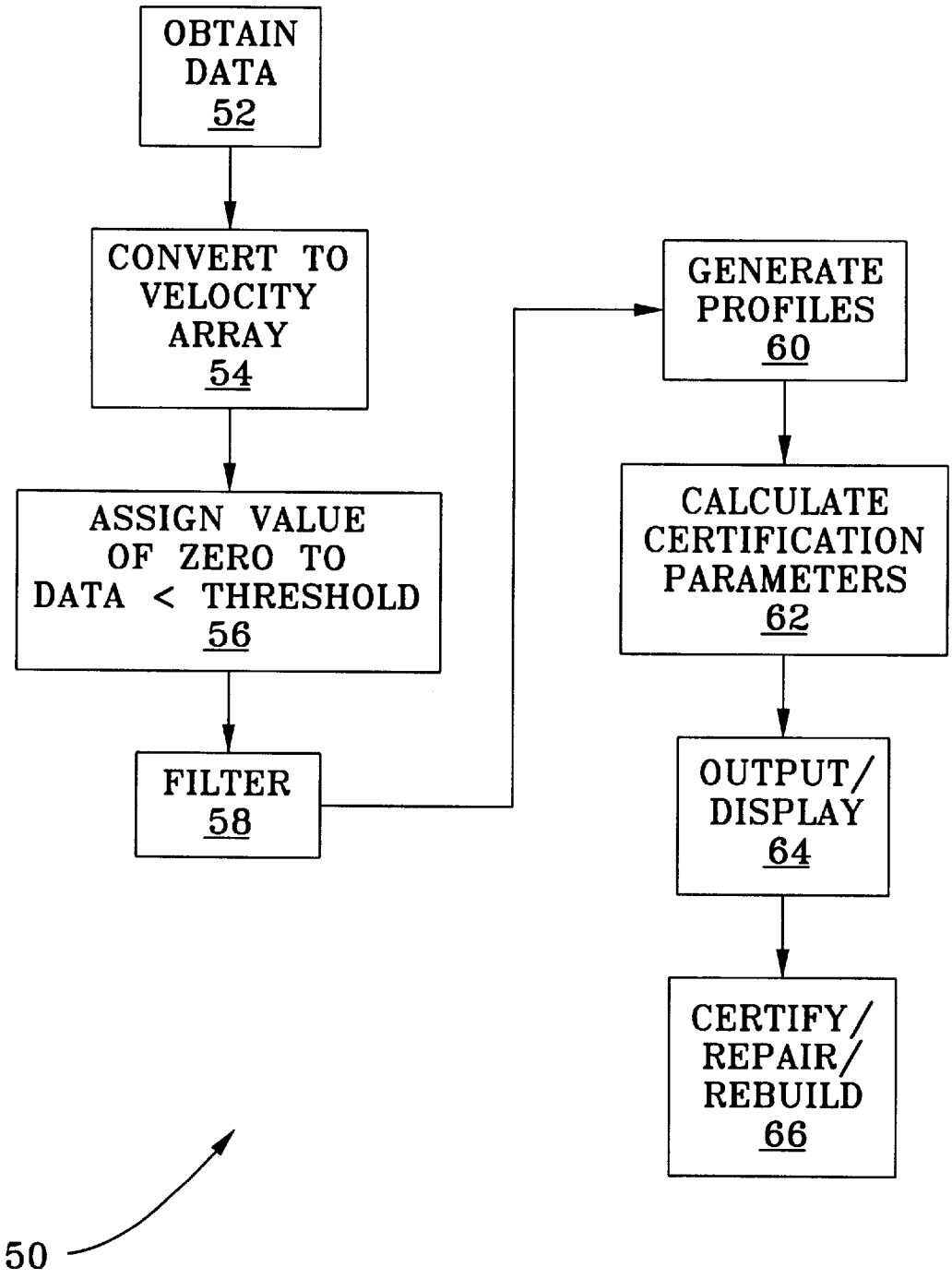
FIG. 2 is a flow chart of the method of the present invention.

Referring now also to FIG. 2, there is shown a schematic flow chart of the method 50 used to determine certification parameters for launch system 10. Method 50 is implemented on a computer, such as computer 24, shown in FIG. 1 as controlling data acquisition system 22. Method 50 begins by obtaining (at 52) input data from acquisition system 22. The input data includes the data sampling rate used by the acquisition system 22, voltage signal data from DC generator 20, the length of tube 14 (feet), a decimation factor used in converting the analog voltage signals to velocity array data (feet/second), the length of acquisition, i.e., the total time period (seconds) for which data was taken, and low pass cut-off frequency (Hz). Method 50 then converts the voltage signals to a velocity array (at 54) and forces any data points less than a predetermined threshold to zero (at 56). The threshold varies with the launch system being tested and can be determined from empirical data for the launch system. In prior art methods for determining certification parameters, a velocity profile was hand fit to the voltage signal data obtained. Ambient noise assumptions were made to keep the derived velocity, acceleration and displacement profiles within known physical parameters of the launch system. Based on this empirical ambient noise data, the threshold for torpedo launch system 10 is set to 0.3 feet/second. Thus step 56 is seen to eliminate any nonzero levels contributed by ambient noise. The data is then passed (at 58) through a forward/reverse filter to smooth the velocity profile. The forward/reverse pass results in zero-phase shift in time, which produces an accurate velocity-time history.

Figure 3:
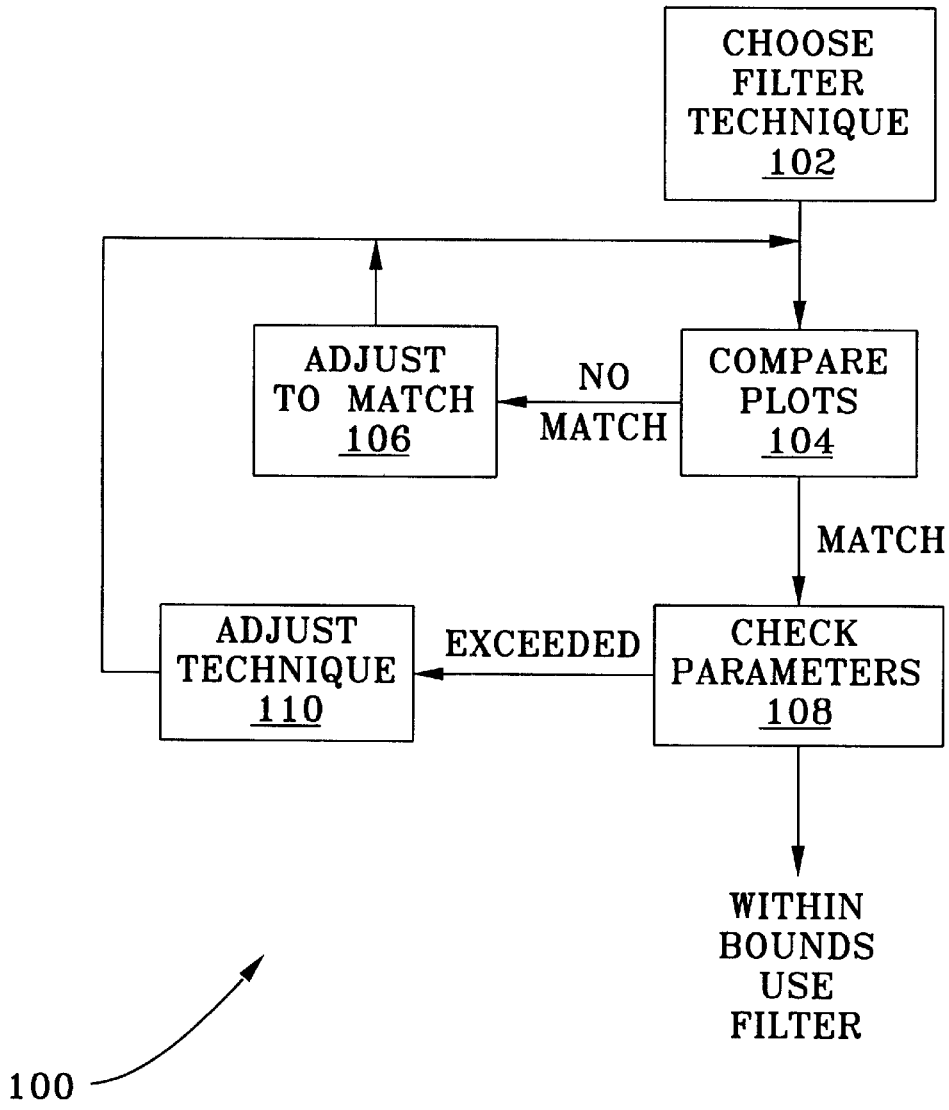
FIG. 3 is a flow chart of a filter selection portion of the present invention.

As with the threshold, the filter used is based on empirical data. In this case, the filter is chosen to match the prior art hand fit profiles. FIG. 3 is a flow diagram of the method 100 used to choose the filtering technique for step 58. A filtering technique is first chosen to smooth out raw data from previous test results (at 102). The resultant plots are compared to the hand fit profiles for the same data (at 104). The filtering technique is adjusted until the filtered profiles match the hand fit profiles (at 106). Additionally, the acceleration and displacement profiles based on the filtered profiles are checked to ensure no known physical parameters of the launch system, such as the system frequency response, are exceeded (at 108). The filtering technique is further adjusted until the profiles match and the physical parameters are within known bounds (at 110).

Using the filtering choosing technique 100 results in a $5^{th}$ order, 6 Hz low pass elliptical filter chosen for the launch system 10. The filter allows 0.005 dB bandpass ripple and a stopband attenuation of 130 dB. Once the velocity profile has been smoothed, acceleration and displacement profiles can be generated (at 60). The acceleration and displacement profiles are generated from the velocity profile using standard mathematical techniques. Additionally, certification parameters, such as peak acceleration, time at peak, pulse duration and muzzle exit velocity, are calculated (at 62). The profiles and parameters are then output and displayed (at 64). Based on the output profiles and parameters, the launch system 10 may be certified for use, or marked for adjustment, repair, or rebuilding (at 66).

The invention thus described provides a method that eliminates hand fitting of velocity data during launch system certification. The method is implemented on a computer and begins by first minimizing ambient noise effects on the data by assigning a value of zero to data below a specified threshold. The threshold is determined by empirical analysis of previous data. A forward/reverse filter is applied to the data to smooth the resultant velocity profile. The forward/reverse filter maintains zero phase shift in time so as to provide an accurate velocity-time history. The specific filter technique used is chosen to match hand fit profiles for previously collected data and to maintain results within physical parameters of the launch system.

Figure 4:
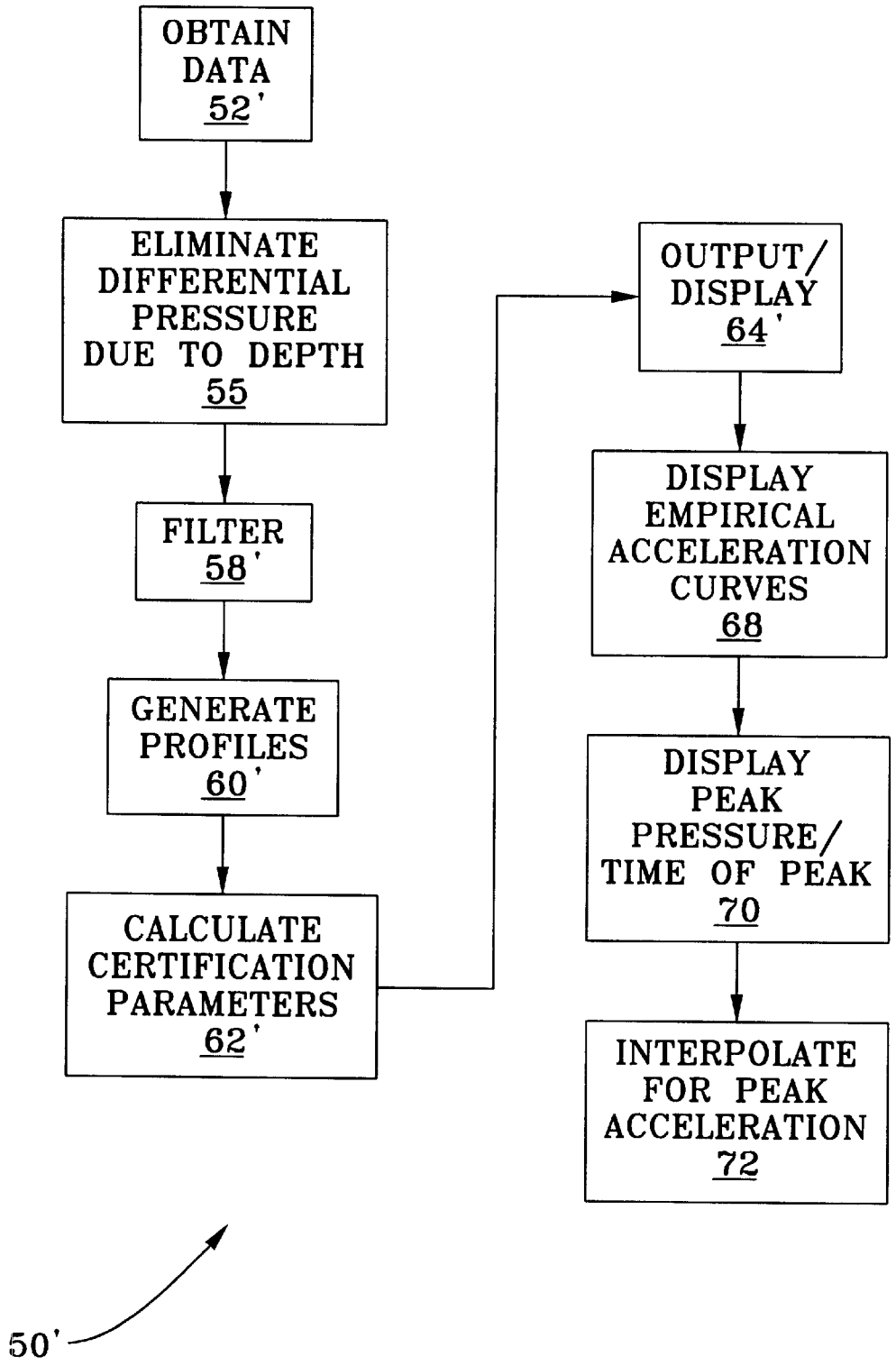
FIG. 4 is a flow chart for a second embodiment of the method of the present invention.

Although the present invention has been described relative to a specific embodiment thereof, it is not so limited. While the method has been described for the torpedo launch system of FIG. 1, it can be used to obtain certification parameters for other types of systems, where smoothed data is required. As an example, a second embodiment provides acceleration estimates for torpedo shapes based on breech door pressure data from water slug tests. A water slug test launch consists of filling the tube 14, which normally holds the torpedo, with water and then operating the launch system to eject the water from the tube 14. For this embodiment, data acquisition system 22 obtains pressure data from sensors at breech door 14*a*. FIG. 4 shows the method, designated as 50', as applied to the breech door pressure data. First, data acquisition system 22 obtains the breech door pressure data from a water slug test (at 52'). For the embodiment of FIG. 4, no conversion is necessary and system cable voltages do not affect the data. Rather, method 50' adjusts the pressure data to eliminate differential pressure due to depth (at 55). The filter is applied (at 58'), a pressure profile is generated (at 60') and various pressure parameters can be calculated (at 62') in a manner similar to that shown in FIG. 2. These parameters include peak differential pressure (relative to base pressure), time at which pressure starts to rise, time at which peak pressure occurs, the time differential between first rise and the time at which a differential pressure of 15 psi is reached (considered to correlate with first motion of a torpedo). The parameters are displayed (at 64') along with a family of acceleration curves based on empirical data (at 68). The point corresponding to peak pressure at time of peak is displayed against the acceleration curves (at 70). The estimated peak acceleration of a weapon launched by the system can then be interpolated from the two acceleration curves the point lies between (at 72).

Depending on the launch system being tested, the certification parameters generated by the method may vary. The method has been described as being implemented on computer 24, which controls acquisition system 22. It can be easily seen that computer 24 can be completely separate from acquisition system 22, or may be integrated within system 22. It is to be noted that, in order to obtain maximum benefit from the method, previous test data should be available to provide sufficient data for empirical analyses to determine the threshold and filtering technique.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method implemented in a computer for determining certification parameters of a system comprising:

inputting test results into the computer;

assigning a value of zero to data below a threshold value;

filtering the data to obtain a smoothed data profile; and calculating the certification parameters based on the smoothed profile;

wherein filtering further comprises:

choosing a filter technique;

comparing plots of previous data generated using the filter technique to hand fit plots of the previous data;

adjusting the filter technique and returning to comparing the plots when the filter generated plots do not match the hand fit plots;

determining physical parameters of the system based on the filter generated plots when the filter generated plots match the hand fit plots;

adjusting the filter technique and returning to comparing the plots when the determined physical parameters exceed known physical parameters of the system; and setting the filter technique for use in filtering the data when the determined physical parameters do not exceed the known physical parameters of the system.

2. The method of claim 1, further comprising determining the threshold value based on empirical data to maintain the certification parameters within physical bounds for the system.

3. The method of claim 1, further comprising:

outputting and displaying the certification parameters; and certifying the system when the parameters are within acceptable bounds.

4. The method of claim 1, wherein the filtering utilizes a forward/reverse filter to obtain zero-phase distortion between certification parameters.

5. The method of claim 1, wherein the system launches a torpedo.

6. The method of claim 5, wherein:

the test results are in the form of analog voltage data; and the voltage data is converted to digital velocity array data prior to assigning a value of zero to data below a threshold value.

7. The method of claim 6, wherein the voltage data is obtained by action of a wire attached to the torpedo, the launch of the torpedo causing the wire to payout from a reel and spin a generator to generate varying voltage from which the voltage data is taken.

8. The method of claim 7 wherein the certification parameters include at least one of velocity, acceleration and displacement.

9. A method for certifying a torpedo launch system based on processing velocity test data for the launch system obtained from a pressure/velocity/displacement housing providing voltage data corresponding to the velocity of a launched torpedo over time, the method comprising:

inputting known system parameters into a computer;

inputting the voltage data into the computer;

converting the voltage data to a velocity array based on the known system parameters;

assigning a value of zero to velocity array elements below 0.3 feet/second;

passing the velocity array through a filter to obtain smoothed velocity data;

plotting the smoothed velocity data as a velocity profile;

plotting acceleration and displacement profiles based on the velocity profile; and determining a certification rating for the system based on certification parameters derived from the profiles.

10. The method of claim 9, wherein the known system parameters comprise at least one of a data sampling rate, a muzzle length, a decimation factor and a low pass cut-off frequency.

11. The method of claim 9, wherein the filter is a $5^{th}$ order, 6 Hz low pass elliptical filter.

12. The method of claim 9, wherein the certification parameters comprise at least one of peak acceleration, time at peak, pulse width and muzzle exit velocity.

13. A method for certifying peak acceleration of a torpedo launch system based on processing breech door pressure test data from a water slug test, the method comprising:

capturing the pressure test data with a computer controlled data acquisition system;

filtering the pressure test data to obtain smoothed test data;

plotting the smoothed test data as a velocity profile;

calculating peak pressure and time to peak pressure based on the smoothed test data;

plotting a point corresponding to the peak pressure at the time to peak pressure against a family of acceleration curves; and interpolating between the acceleration curves adjacent the point to obtain the peak acceleration for the launch system.

14. The method of claim 13, wherein the filtering further comprises:

choosing a filter technique;

comparing plots of previous data generated using the filter technique to hand fit plots of the previous data;

adjusting the filter technique and returning to comparing the plots when the filter generated plots do not match the hand fit plots;

determining physical parameters of the launch system based on the filter generated plots when the filter generated plots match the hand fit plots;

adjusting the filter technique and returning to comparing the plots when the determined physical parameters exceed known physical parameters of the system; and setting the filter technique for use in filtering the pressure test data when the determined physical parameters do not exceed the known physical parameters of the system.

* * * * *